US005560437A

United States Patent [19]

Dickel et al.

[11] Patent Number: 5,560,437

[45] Date of Patent: Oct. 1, 1996

[54] TELEMETRY METHOD FOR CABLE-DRILLED BOREHOLES AND METHOD FOR CARRYING IT OUT

[75] Inventors: Udo Dickel, Hamm; Helmut Palm, Dortmund; Clemens Hinz, Marl-Sinsen all of Germany

[73] Assignees: Bergwerksverband GmbH; Ruhrkohle Aktiengesellschaft, both of Essen, Germany

[21] Appl. No.: 204,320

[22] PCT Filed: Sep. 4, 1992

[86] PCT No.: PCT/EP92/02043

§ 371 Date: Jul. 25, 1994

§ 102(e) Date: Jul. 25, 1994

[87] PCT Pub. No.: WO93/05271

PCT Pub. Date: Mar. 18, 1993

[30] Foreign Application Priority Data

Sep. 6, 1991 [DE] Germany ..... 41 29 709.1

[51] Int. Cl.[6] ..... F21B 47/02; E21B 47/12

[52] U.S. Cl. ..... 175/40; 166/64; 166/254.2; 166/385

[58] Field of Search ..... 175/40, 45; 166/64, 166/66, 65.1, 254.2, 385

[56] References Cited

U.S. PATENT DOCUMENTS

| | | | |
|---|---|---|---|
| 2,868,506 | 1/1959 | Nestle | 166/254 X |
| 3,086,167 | 4/1963 | Chaney | 324/347 |
| 4,001,774 | 1/1977 | Dawson | 340/854.6 |
| 4,003,441 | 1/1977 | Lokshin | 166/254 X |
| 4,932,471 | 6/1990 | Tucker et al. | 166/65.1 X |
| 4,955,438 | 9/1990 | Juergens | 175/40 |
| 5,234,053 | 8/1993 | Connell | 166/64 X |
| 5,353,872 | 10/1994 | Wittrisch | 166/385 X |

FOREIGN PATENT DOCUMENTS

| | | |
|---|---|---|
| 546119 | 8/1985 | Australia . |
| 0056872 | 8/1982 | European Pat. Off. . |
| 0299863 | 1/1989 | European Pat. Off. . |
| 0330558 | 8/1989 | European Pat. Off. . |
| 3035905 | 9/1980 | Germany . |
| 3402386A1 | 8/1985 | Germany . |
| 1096388 | 12/1967 | United Kingdom . |
| 1557863 | 12/1979 | United Kingdom . |
| 2188352A2 | 9/1987 | United Kingdom . |

OTHER PUBLICATIONS

US–Z: Journal of Petroleum Technology, 1980, pp. 191–198.

Composite Catalog of Oil Field Equipment and Services, Gulf Publishing Co., pp. 369–400.

Prickel, Gottfried: Tiefbohrtechnic, Springer–Verlag, Vienna, 1959, pp. 369–400.

*Primary Examiner*—David J. Bagnell
*Attorney, Agent, or Firm*—Herbert Dubno

[57] ABSTRACT

A telemetry system for obtaining loggings by an independently guiding logging probe provided with a sensor includes the logging probe ejected in a drill string, so that the sensor projecting through a drill bit of the drill string has an access to the bottom and walls of the drill bore, a pick-up probe injectable into the drill string to form a wireless connection with the logging probe and connected to a portable computer which initializes the logging probe, loggings stored in the logging probe are readable from the portable computer upon recovering the logging probe from the bore string.

10 Claims, 6 Drawing Sheets

TELEMETRY METHOD FOR CABLE-DRILLED BOREHOLES AND METHOD FOR CARRYING IT OUT

CROSS REFERENCE TO RELATED APPLICATIONS

This application is a national phase of PCT/EP92/02043 filed Sep. 4, 1992 and based, in turn, on German national application P4129709.1 filed Sep. 6, 1991 under the International Convention.

FIELD OF THE INVENTION

The invention relates to a telemetry method for cable-drilled boreholes as well as an apparatus for carrying out the method.

BACKGROUND OF THE INVENTION

The publication "Horizontal Well Logging by 'Symphor' (Eighth European Formation Evaluation Symposium, London, 1983) describes a borehole-logging method and the corresponding apparatus particularly directed at logging horizontal or slant boreholes by a logging probe on the end of the drill string and a logging cable extending between the drill string and logging cart on the surface and movable by a cable winch. The logging probe comprises a massive rod mechanically and electrically connected with the cable shoe and to which a coupling rod is connected which is connected behind the logging tools. The probe furthermore has a coupling housing for connection to the drill string and a protective housing for the logging tools and having an aperture. With this telemetry method and with the corresponding apparatus there is the disadvantage that the logging probe is fixed on the drill string so that the drill string must be taken apart before every logging in order to take the bit off the lower end of the drill string and to install the logging probe there.

Furthermore from "Efficiently log and perforate 60°+ wells with coiled tubing" (*World Oil,* July 1987, pp. 32, 33, and 35) a method and a telemetry apparatus are known wherein instead of the drill string a special windable hose is used with a special hose winch and on whose end a logging probe, for example a gamma-ray probe, is connected as a locating probe for casing joints or as an acoustic sound for checking the annular cement joints between the casing and the surrounding rock. With this telemetry method and the apparatus for carrying it out it is possible to do a quick check of such bores after the derrick has been removed. On the other hand it is disadvantageous that one must use a special winch and a special hose string in order to make the necessary loggings.

OBJECTS OF THE INVENTION

It is an object of the invention to provide an improved telemetry method for cable-drilled boreholes. wherein the logging probe can be changed without dismantling the drill string. Yet another object of the invention is to provide an apparatus for carrying out the method according to the invention.

SUMMARY OF THE INVENTION

Still another object is to provide a telemetry method.

The telemetry method according to the invention for cable-drilled boreholes and the corresponding apparatus are ideal for geophysical loggings of strongly inclined bores.

With this new telemetry concept, which is based on the method according to the invention having the step of independently functioning logging probe which is jetted into the drill string and projecting sensors forwardly out of the drill bit, there is no necessity to dismantle the drill string so that the effort and time necessary for making the loggings can be substantially reduced. During the logging procedure itself there is no need for a cable connection so that no expensive side apertures in the drill string are necessary. Since the logging probe is mounted inside the string, there is no way to lose it.

Even when the logging probe is switched it is no longer necessary to dismantle the string completely since each logging probe, similar to a solid core tube, can be taken rapidly by means of the core-tube grab out of the drill string whereupon with equal speed a new logging probe can be jetted into place. Use of the method of the invention eliminates problems when making the loggings because one can make loggings immediately after drilling without having to pull out the drill string. The outside diameter of the logging probe corresponds to that of a cable tube and can be easily secured via the inner-tube head to the core-tube coupling.

The jetting system in the inner-tube head of the logging probe and in the pickup probe allows wireless (inductive) communication from the surface location with the microprocessor of the logging probe. To this end the logging cable of the pickup probe is connected to a laptop PC or portable personal computer on the surface in order to initialize the logging probe before beginning the loggings and to synchronize it with the laptop PC.

The logging probe is then able in a fixed time, e.g. 1/10 sec, to take loggings and write them in its semiconductor memory of at least 1 megabyte capacity. Before the actual logging procedure, which takes place with dismantling of the string, the pickup probe is taken out of the borehole to protect the logging cable from damage.

Preferably with each logging the depth change is ascertained with a logging wheel which is provided on the surface at the string and thereafter it is written by the laptop PC in a data file. Once the loggings are complete the logging probe is recovered by the core-tube grab, is opened, and is read by the laptop PC. Simultaneously the loggings are correlated with the time information and a depth-data file is produced which can be printed out there on a printer.

If necessary the loggings can be interrupted and by jetting of the pickup probe the logging probe can be checked. In limited circumstances the loggings are read by the pickup probe directly and transmitted to the laptop PC.

BRIEF DESCRIPTION OF THE DRAWING

The above and other features, objects and advantages will become more readily apparent from the following description references being made to the following accompanying drawing, in which.

SPECIFIC DESCRIPTION

Figure 1:
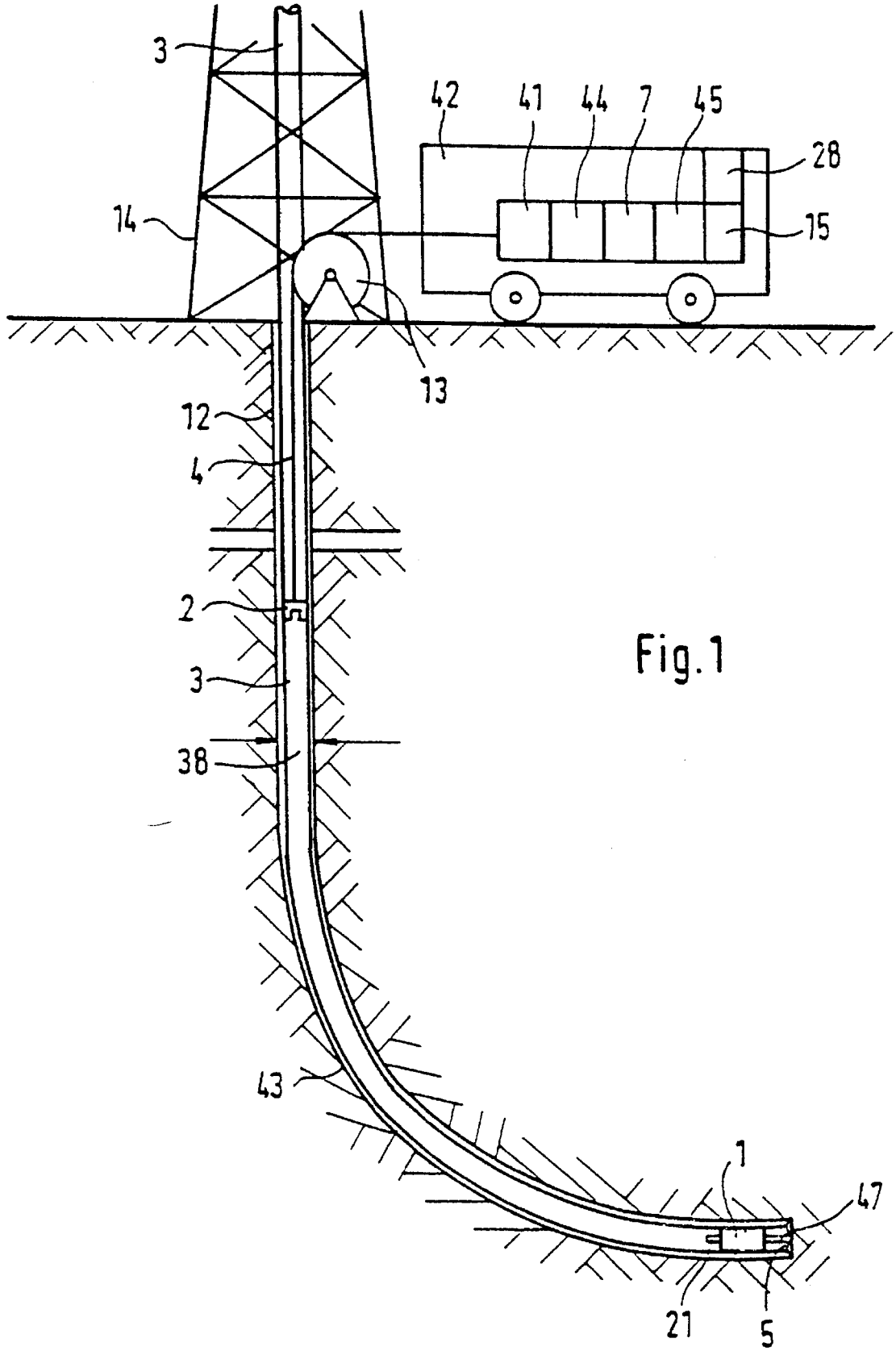
FIG. 1 is a schematic representation of a telemetry method for cable-drilled boreholes as well as a method for carrying out the method according to the invention.

FIG. 1 shows, to illustrate principles of the telemetry method of the invention as well as the apparatus for carrying out the method, a probe 1 according to the invention in a deflected portion 43 of a borehole 12 as well as a pickup probe 2 working therewith and in a well string 3 that is in the borehole 12, 43. The probe 1 is conveyed to its logging location in the region of a drill bit 5 by the drilling mud. The pickup probe 2 is still in the upright portion of the borehole 12. It is also driven by the drilling mud along the string 3 until it is in a working position directly behind the logging probe 1. The pickup probe 2 is mounted on a borehole-logging cable 4 that is braked on paying out and tensioned on drawing in by a logging-cable pulley 13. The logging-cable pulley 13 is shown in the schematic drawing adjacent a derrick 14. The borehole logging cable 4 is connected in this embodiment to a logging cart 42 in which is mounted a laptop PC 7 with a register 41, a data processor 44, a memory 45, a printer 15, and a battery 28 as energy source. The logging probe 1 and pickup probe 2 are connected wirelessly to each other in the working position by means of a soft-magnet core 21 and two induction spools 9 (logging probe 1) and 10 (pickup probe 2) seen in FIG. 2. The self-powered logging probe 1 has a sensor 47 which can reach through a logging aperture in the bit 5 for direct mechanical contact with the floor and walls of the borehole 12, 43 in order to collect loggings, for example about the composition of the subsurface, the borehole walls, and the borehole diameter 38.

Figure 2:
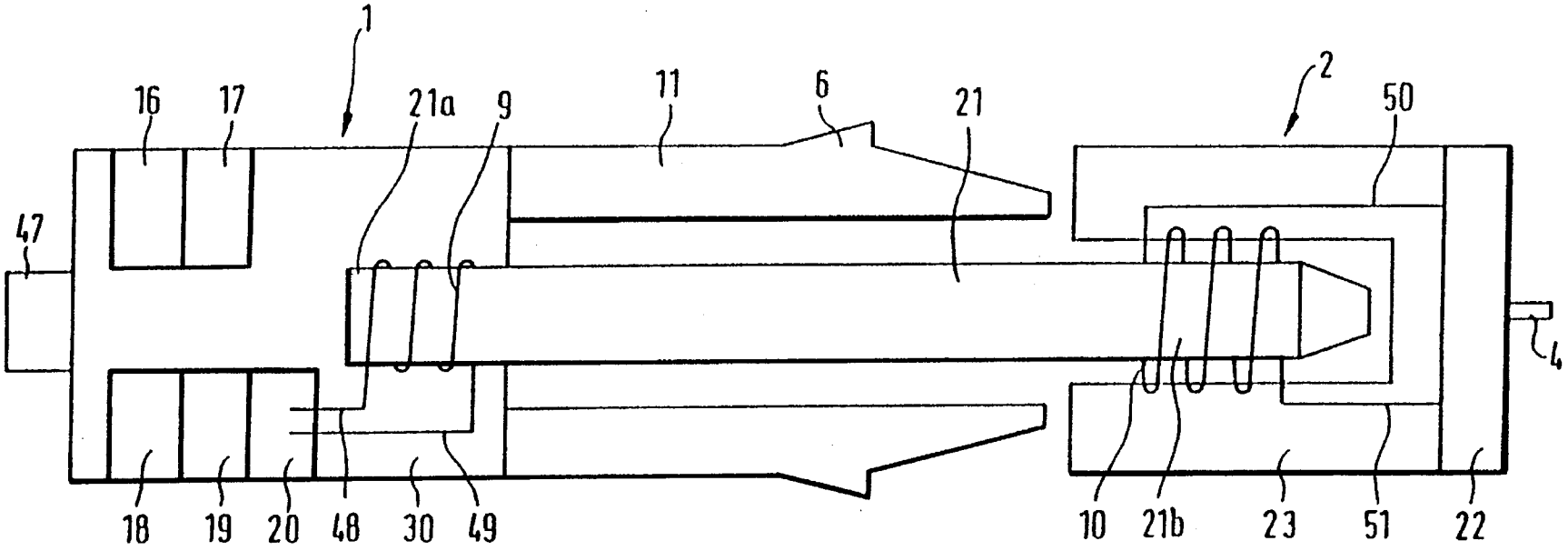
FIG. 2 is a schematic representation of a wireless logging and pickup probe unit.

FIG. 2 shows the logging probe 1 and the pickup probe 2 interengaged to form a logging and transmitting unit in a data-transmission position. This drawing also shows the general construction of the logging probe 1 and pickup probe 2. The logging probe 1 has a longing-probe housing 30 holding a logging element 16, a power-source battery 17, a data processor 18, a data memory 19, as well as a serial data transfer device 20. The logging-probe housing 30 is behind the logging sensor 47 that during logging projects from the logging aperture of the bit 5. The rear end of the logging probe 1 carries an inner-tube head 11 which is connectable via a core-tube coupling 6 for fixing the logging probe 1 in the drill string 3 or on the bit 5. The side of the logging-probe housing 30 opposite the bit 5 centrally carries a soft-magnet core 21. The fixed magnet end 21a is surrounded by windings of an induction coil 9 whose connections 48 and 49 lead to the serial data transmitter 20. The soft-magnet core 21 extends with its free end 21*b* past the inner-tube head 11. In the transmission position the free magnet end 21*b* is surrounded by a coil part 23 in which the induction coil 10 of the pickup probe 2 is mounted. The coil part 23 is mounted on a cable head 22 in which the end of the borehole-logging cable 4 is fixed. Two terminals 50 and 51 of the induction coil 10 are connected via the cable head 22 with the borehole-logging cable 4. In the illustrated arrangement a wireless data transmission from the laptop PC 7 to the logging probe 1 is facilitated in order to initialize it and to synchronize it with the laptop PC 7. Finally the logging probe 1 is able to receive logging data and store it in the data memory 19. The pickup probe 2 can then be pulled by the logging-cable winch 13 out of the borehole 12, 43. The logging data is read as the bore string 3 is pulled out of the borehole 12, 43. Differentiated pulses of an RS232 protocol are used. Normally with an RS232 protocol the sent and received data are exchanged over two separate channels. Here it is necessary to transmit the data at different times over one channel.

Figure 3:
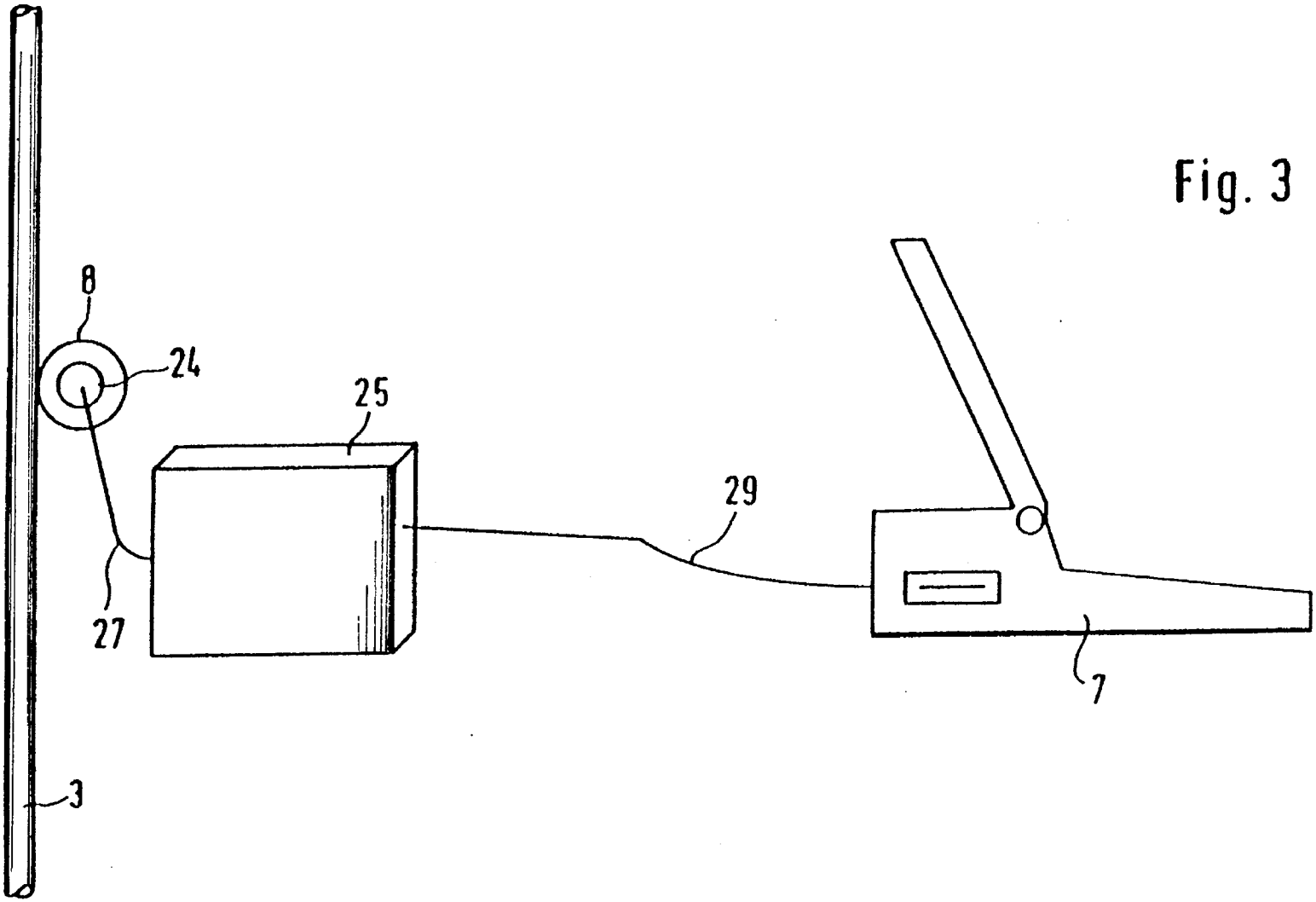
FIG. 3 is a schematic representation of a length-logging device.

As the logging data is being read the borehole depth is determined. This is done by the depth-logging device shown in FIG. 3. Engaged laterally with the uppermost string of the logging string 3 is a depth-logging wheel 8 whose rotations are outputted by a pulse generator 24 through a logging line 27 to a pulse counter 25 which is connected via a transmission circuit 29 to the laptop PC 7. Since the laptop PC 7 and the logging probe 1 work synchronously, all of the collected data can be combined, that is the logging data can be associated with the depth it was taken at.

Figure 4:
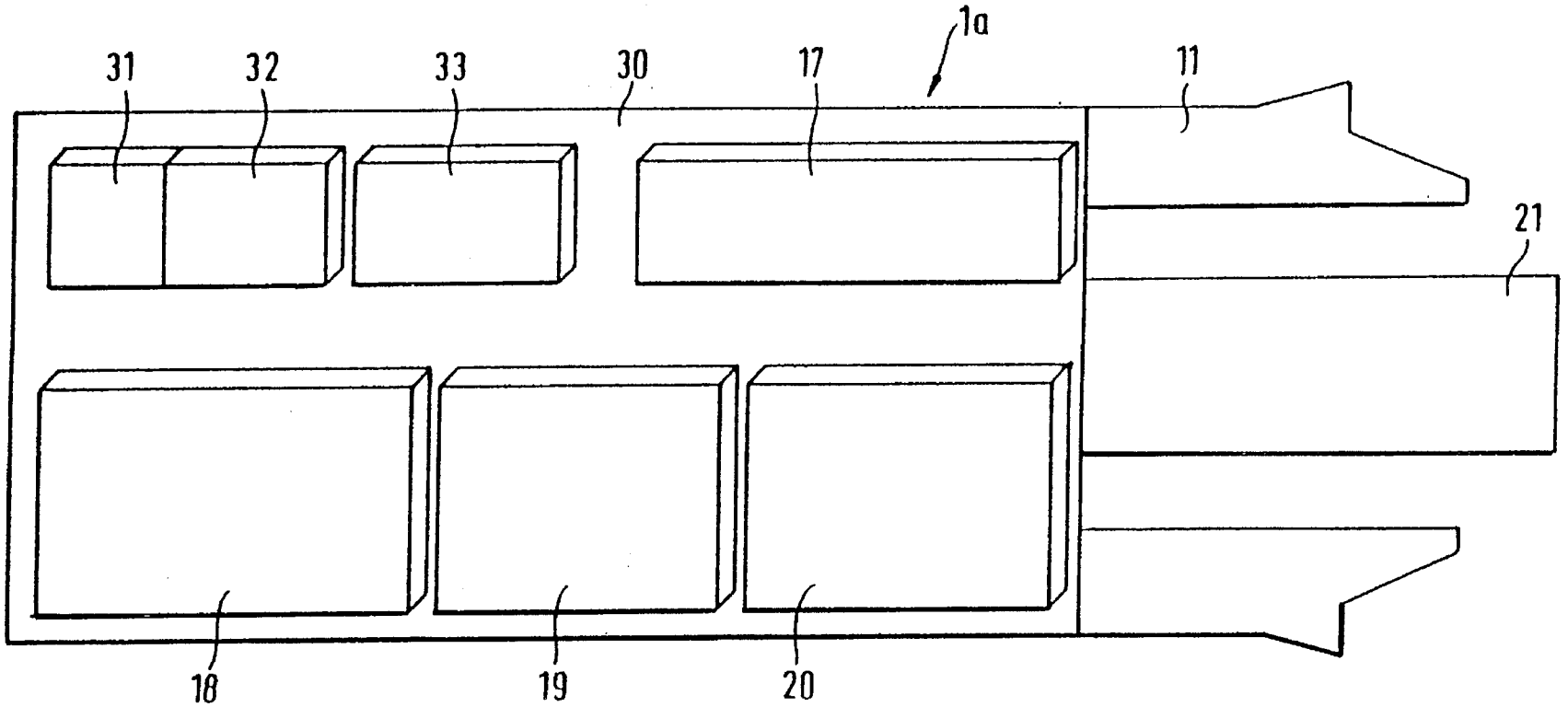
FIG. 4 is a schematic representation of a gamma-ray probe.

It is possible for example to use a gamma-ray probe 1*a* as the logging probe 1, which is shown schematically in FIG. 4. The logging-probe housing 30 holds a sodium-iodide crystal 31 and an electron-multiplying tube 32 to which is connected a voltage converter 33 that is used to obtain the logging data. These are fed via a data processor 18 to the data memory 19 from which they can be read by the serial date transmitter 20. A battery 17 is the power source. Although radioactive loggings are also possible through the drilling string, loggings not influenced by the drill string are obtained by the solution whereby a radioactive emitter is used first and the gamma-ray probe 1*a* is used as a density probe. The sensor system of the radioactive logging can be monitored well and the exceptional logging data are minimal. With a 1 megabyte memory in the gamma-ray probe 1*a* one can take loggings for more than 24 hours.

Figure 5:
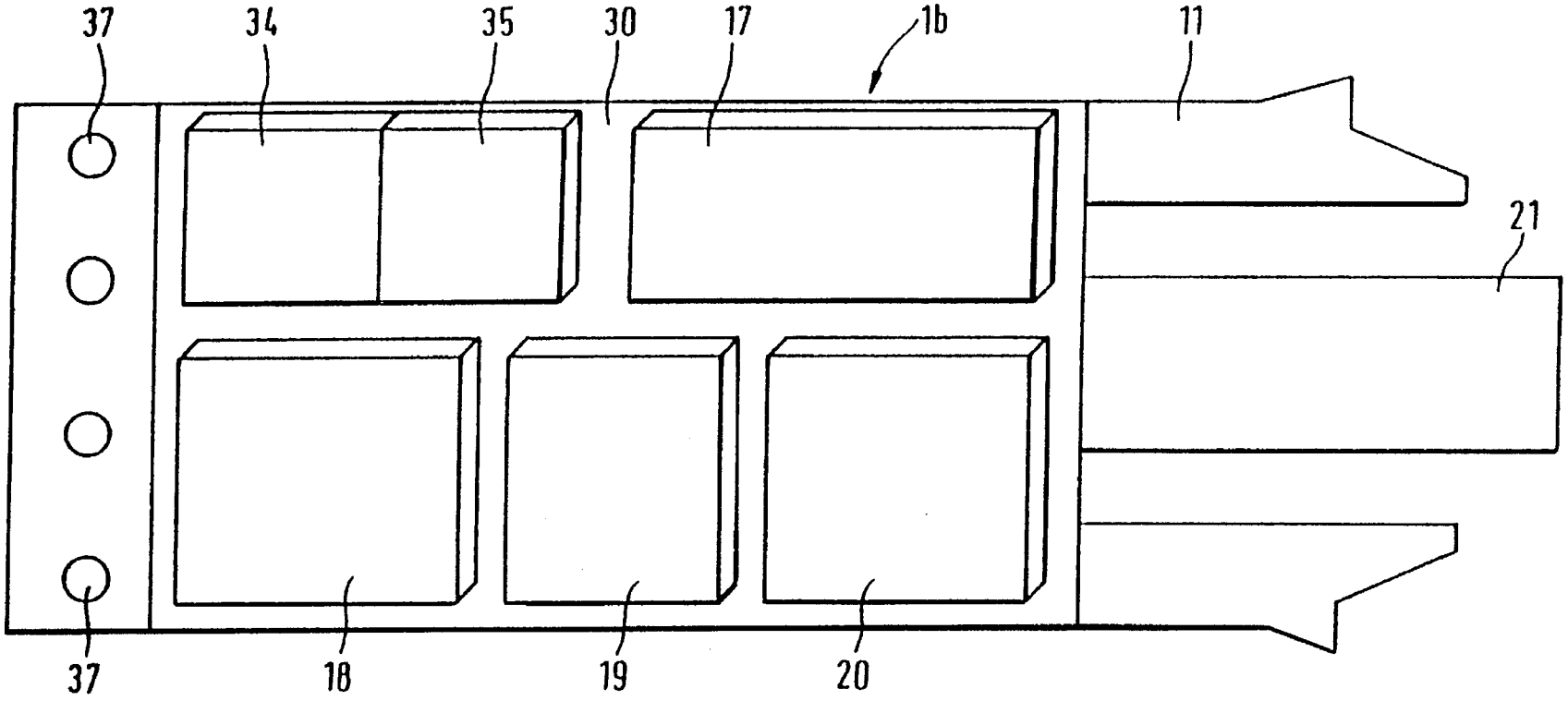
FIG. 5 is a schematic representation of a dip-meter probe.

The logging probe 1 can furthermore be for example a dip-meter probe 1*b* as shown in FIG. 5. Its housing 30 has a tip potentiometer 34 and an electronic analog circuit 35 acting as data-logging device which receives the reflections of ultrasonic signals that are emitted by an ultrasonic oscillator 37 which is connected to the probe housing 30. Furthermore the probe housing 30 holds a battery 17 as current source as well as a data processor 18, a data memory 19, and a serial data transmitter 20. The dip-meter probe 1*b* serves to determine the position of layer boundaries and fissures. Several fixed ultrasound oscillators 37 log by sonic echo-sounding techniques the amplitude and running time without contact. The ultra-sound pulses are diffused by the fissures and layer boundaries and are reflected with lessened intensity from the borehole wall.

These amplitude values can be subjected to successive evaluation and display methods as is known for electrical dip meters. The sum of all the ultrasound pulse times represents the borehole diameter 38 whose value is stored as a further value along with the amplitude. The orientation value is taken from the electrical tip potentiometer 34 and determines in which position relative to the roll axis of the dip-meter probe the ultrasonic oscillator 37 is oriented. This ensures a simple up/down orientation.

For final location of layers and fissures the loggings are then correlated with the travel and position of the borehole 12, 43 which is done with a gyroscopic probe which is described below.

By selection of another probe program when initialized the dip-meter probe 1*b* can also be used as a diameter probe. In contrast to the dip-meter action the diameter values are stored. The exact diameter values are of significance in combination with the density loggings from the gamma-ray probe 1*a* (gamma-gamma).

In addition the dip-meter probe 1*b* can make volume loggings of the borehole 12. To this end on assembly of the string 3 the dip-meter probe 1*b* is locked in place and the depth is logged by means of the depth-meter wheel 8 and the laptop PC 7. The dip-meter probe 1*b* allows highly accurate loggings to be made with a resolution of as little as 1 mm.

Figure 6:
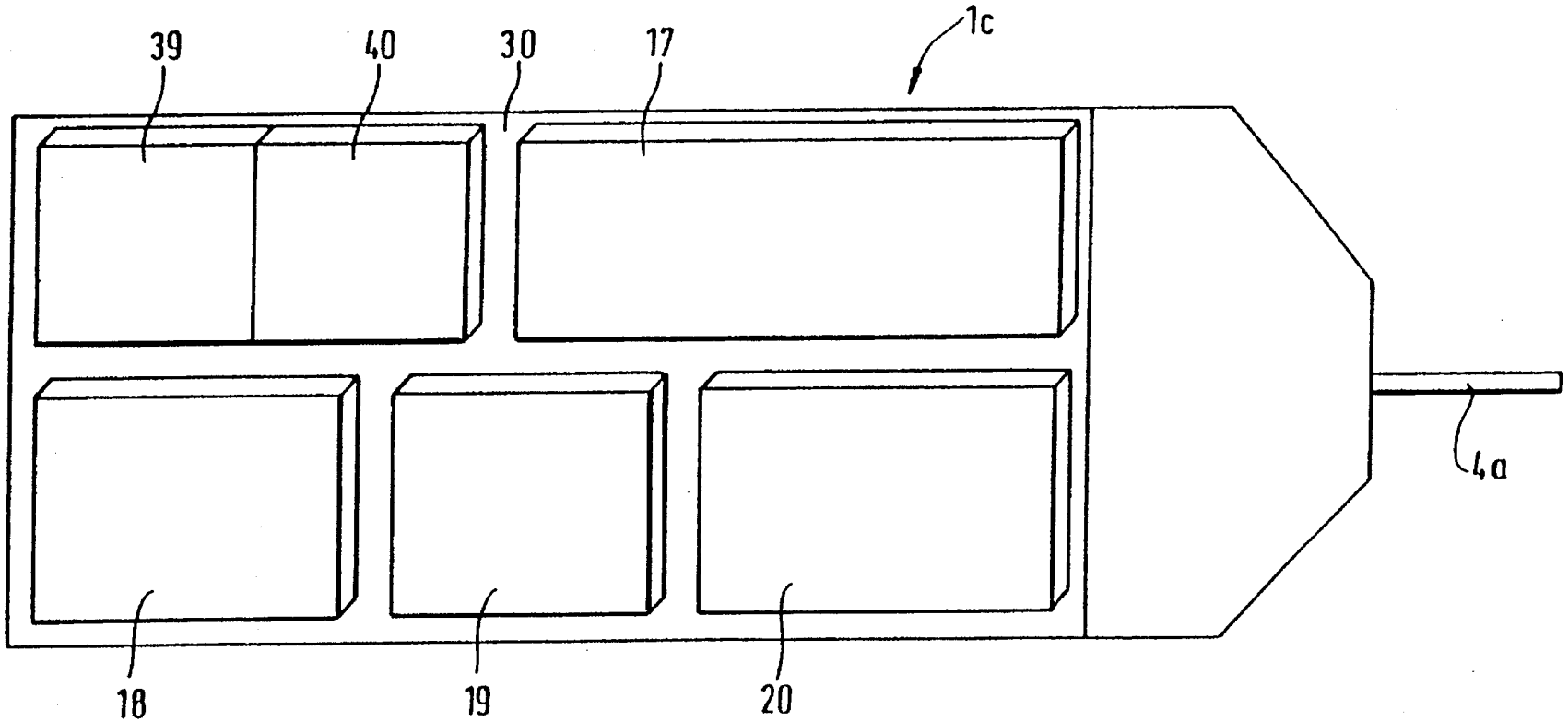
FIG. 6 is a schematic representation of a gyroscopic probe working both as a logging probe and as a pickup probe.

As shown in FIG. 6 the logging probe 1 can be a gyroscopic probe which is used alone or with another of the logging probes 1 and 1*a* or 1*b* to determine the loggings of interest. The probe housing 30 of the gyroscopic probe 1*c* is a gyroscopic module 39 and if necessary is integrated with an additional sensor 40 as logging derive. The gyroscopic probe 1*c* determines the path of the borehole 12, 43 and the position of the deepest part of the borehole with an accuracy of 1 m in 1000 m depth. It is lowered by the borehole-logging cable 4*a* into the drill string 3 and continuously logs the travel and position of the borehole 12, 43. When inclined greatly it can be propelled forward by a piston. While logging, the data are transmitted to the logging cart 42 and there are stored in the register unit 41. The additional sensor 40 allows one to simultaneously determine the position of the tube joints of the drill string 3. As with the logging probes 1*a* and 1*b* the housing 30 of the gyroscopic probe 1*c* holds a battery 17 for supplying current as well as a data processor, a data memory, and a serial data transmitter.

We claim:

1. A telemetry method for cable-drilled boreholes, said method comprising the steps of:

(a) injecting an independently functioning logging probe along a drill string removable from a drill bore, said logging probe including a core-tube coupling and a logging sensor;

(b) arresting said logging probe at a drill bit of the drill string so that said logging sensor projects through an aperture of the drill bit to have a free access to the bottom and walls of the drill bore;

(c) thereafter injecting a pick-up probe on a logging cable connected to a portable computer into said drill string to form a wireless connection between said probes, and initializing the logging probe by the personal computer, said computer and logging probe being synchronized upon initializing;

(d) taking and temporarily storing loggings from said logging probe with said personal computer;

(e) drawing said pickup probe out of the drill bore;

(f) thereafter recovering the logging probe with an inner tube grab; and (g) reading out the loggings from the portable computer.

2. The telemetry method defined in claim 1, further comprising the step of deriving respective logging depths by a travel indicator and storing their times in the portable computer.

3. The telemetry method defined in claim 1, further comprising the step of evaluating the various logging probes sequentially one after another and together with the depth of said drill hole.

4. The telemetry method defined in claim 1, further comprising a step of transmitting said loggings wirelessly to the pickup probe before the reading by the portable computer.

5. A telemetry method for cable-drilled boreholes, said method comprising the steps of:

(a) injecting an independently functioning gyroscopic probe along a drill string removable from a drill bore, the gyroscopic probe including a logging sensor;

(b) arresting said gyroscopic probe at a drill bit of the drill string so that the logging sensor projects through an aperture of the drill bit to have a free access to the bottom and walls of the bore;

(c) connecting the gyroscopic probe with a borehole-logging cable directly connected with a portable computer and initializing said gyroscopic probe, said personal computer and the logging probe being synchronized upon initializing;

(d) temporary storing in and taking from the gyroscopic probe the loggings with the personal computer;

(e) thereafter recovering the gyroscopic probe; and (f) reading out the loggings by the portable computer.

6. An apparatus for carrying out the telemetry method, comprising:

means including a logging string and a drill bit for forming a borehole, said drill bit defining a lower end of the bore string and having an aperture in a trailing end;

a logging probe injectable along said string and including:

means on a leading end of said probe for arresting the logging probe at said drill bit and provided, sensing means protrudable through said aperture of said drill bit for taking loggings in the borehole, means for energizing said sensing means;

logging processing means for processing information obtained by said sensing means, storing means for temporary storing said information, and inner-tube head on a rear end of said probe housing a soft-magnet core surrounded by a first induction coil;

a displaceable logging-cable head formed with a pickup probe having a second a coil wirelessly engaging the first coil;

a portable computer provided with data processing means for reading out said information stored in said logging probe; and a borehole cable connecting said logging-cable head and portable computer, said computer being a data-pickup device including a data memory, and a serial data transmitter, said data-pickup device being synchronized with and initializing said logging probe upon the wireless contact between said pickup and logging probes.

7. The apparatus defined in claim 6, further comprising:

a pulse generator emitting a signal at a pulse rate, a depth-logging wheel connected to an upper end of the drill string and rotatable at said pulse rate; and counting means including a pulse counter operatively connected with said computer for determining a borehole depth.

8. The apparatus defined in claim 6 wherein said logging probe is a gamma-ray probe provided with a sodium-iodide crystal sensor and with an electron multiplier tube detector.

9. The apparatus defined in claim 6 wherein the logging probe is an acoustic dip meter formed with a plurality of ultrasonic oscillatory sensors and with an electronic analog circuit and a tip potentiometer.

10. The apparatus defined in claim 6 wherein the logging probe is a gyroscopic probe including:

a gyroscope module provided with means for determining a path and depth of the borehole derived from said logging, and means for determining a position of tube joints of said drill string.

* * * * *